US008689383B2

(12) United States Patent
Han

(10) Patent No.: US 8,689,383 B2
(45) Date of Patent: Apr. 8, 2014

(54) UPPER STRUCTURE FOR BRIDGE

(75) Inventor: Man-Yop Han, Yongin-si (KR)

(73) Assignee: Supportec Co., Ltd., Seoul (KR)

( * ) Notice: Subject to any disclaimer, the term of this patent is extended or adjusted under 35 U.S.C. 154(b) by 0 days.

(21) Appl. No.: 13/877,149

(22) PCT Filed: Sep. 29, 2011

(86) PCT No.: PCT/KR2011/007202

§ 371 (c)(1),
(2), (4) Date: Mar. 29, 2013

(87) PCT Pub. No.: WO2012/044094

PCT Pub. Date: Apr. 5, 2012

(65) Prior Publication Data

US 2013/0263392 A1 Oct. 10, 2013

(30) Foreign Application Priority Data

Sep. 30, 2010 (KR) ..... 10-2010-0095313

(51) Int. Cl.
*E01D 19/02* (2006.01)

(52) U.S. Cl.
USPC ..... 14/74.5; 14/75

(58) Field of Classification Search
USPC ..... 14/74.5, 75; 52/283, 300; 405/231
See application file for complete search history.

(56) References Cited

U.S. PATENT DOCUMENTS

| | | | | |
|---|---|---|---|---|
| 3,398,498 | A * | 8/1968 | Krauss | 52/691 |
| 4,229,919 | A * | 10/1980 | Hughes | 52/263 |
| 4,373,837 | A * | 2/1983 | Lin et al. | 405/218 |
| 6,108,998 | A * | 8/2000 | Dumlao | 52/783.17 |
| 6,449,791 | B1 * | 9/2002 | Vodicka | 14/75 |
| 7,373,683 | B2 * | 5/2008 | Moon | 14/74.5 |
| 8,316,495 | B2 * | 11/2012 | He | 14/77.1 |
| 8,393,116 | B2 * | 3/2013 | Reeve et al. | 52/6 |
| 8,458,839 | B2 * | 6/2013 | Porter | 14/77.1 |

FOREIGN PATENT DOCUMENTS

| | | | |
|---|---|---|---|
| JP | 2007032232 | A | 2/2007 |
| KR | 100592505 | B1 | 6/2006 |
| KR | 1020080074832 | A | 8/2008 |
| KR | 1020090001261 | A | 1/2009 |
| KR | 1020090057180 | A | 6/2009 |
| KR | 1020090122608 | A | 12/2009 |
| KR | 100966144 | B1 | 6/2010 |

OTHER PUBLICATIONS

Korean Intellectual Property Office, International Search Report of PCT/KR2011/007202, WIPO, Apr. 13, 2012, 4 pages.

* cited by examiner

*Primary Examiner* — Gary Hartmann
(74) *Attorney, Agent, or Firm* — Alleman Hall McCoy Russell & Tuttle LLP

(57) ABSTRACT

An upper structure for a bridge includes a coping placed on the top of a pier, and girders held by the coping, wherein the coping has girder holding grooves. The girders are installed continuously without using bridge bearings. The coping and the girders behave in an integrated state. The girders are held by being fitted into the grooves, so the coping is not excessively exposed to the outside. The girders and the coping are dry joined together in a prestressed state using prestressed steel strands. Further, the girders and the coping can be integrated with each other without being processed by site work.

7 Claims, 9 Drawing Sheets

UPPER STRUCTURE FOR BRIDGE

TECHNICAL FIELD

The present disclosure is the national phase of International Application

PCT/KR2011/007202, entitled Upper Structure for Bridge, filed Sep. 29, 2011, which claims the benefit of Korean Patent Application No. 10-2010-0095313, filed on Sep. 30, 2010, the contents of each of which are entirely incorporated herein by reference for all purposes. The present disclosure relates generally to upper structures for bridges and, more particularly, to an upper structure for bridges in which a coping and girders behave in an integrated state.

BACKGROUND ART

Generally, bridges are structures that are constructed in various types and various shapes considering the types of objects to be supported by the bridges and the uses of the objects. Further, the bridges function to safely keep up the functions of passageways or facilities supported by the bridges, so the bridges must have a sufficient degree of strength and endurance.

As shown in FIG. 1, a conventional upper structure for a bridge includes a coping 2 that is placed on the top end of a pier 1, girders 4 that are held on the coping 2 with the interposition of respective bridge bearings 3, and a deck (not shown) that is laid on the girders 4 and forms a passageway for vehicles.

As shown in FIG. 2, the girders 4, which are placed to be adjacent to each other in a longitudinal direction of a bridge, are arranged continuously on the pier 1 and on the coping 2. Here, the continuous arrangement of the girders may be accomplished in a prestressed state in which a prestressed member (prestressed steel strand) 5 is installed.

DISCLOSURE

Technical Problem

However, in the conventional upper structure for bridges, to realize the continuous arrangement of girders, it is required to necessarily use bridge bearings. Further, in the conventional upper structure for bridges, the girders and the coping are configured to behave individually, and so the conventional upper structure for bridges is mechanically inefficient. Further, in the conventional upper structure for bridges, the girders are placed on the top end of the coping such that the upper portion of the coping is excessively exposed to the outside and spoils the appearance of the bridges.

Accordingly, the present disclosure has been made keeping in mind the above problems occurring in the prior art, and an object of the present invention is to provide an upper structure for bridge, in which girders can be installed continuously without using conventional bridge bearings, in which a coping and the girders can behave in an integrated state, and which can realize a good appearance of bridges.

Technical Solution

In order to accomplish the above object, the present disclosure provides an upper structure for bridge, comprising a coping placed on a top end of a pier, and a girder held by the coping, wherein a groove is formed in the coping so as to receive the girder therein so that the girder is held by the coping by being inserted into the groove.

The groove may have a reversed trapezoidal shape in which an upper end of the groove is wider than a lower end of the groove, thereby allowing the girder to be easily inserted into the groove.

The girder may be provided with a reinforcing part such that the reinforcing part comes into close contact with an inner surface of the groove.

The coping may comprise a plurality of grooves formed in a longitudinal direction of the coping such that a plurality of girders can be arranged by being inserted into the grooves.

The coping and/or the girder may be provided with a plurality of hollow openings so as to reduce a weight thereof.

The coping and the girder may be connected to each other by a plurality of prestressed members that are installed in a longitudinal direction of the coping so as to prestress the bridge in a width direction of the bridge.

The girder may be provided with a plurality of prestressed members that are installed in a longitudinal direction of the girder so as to prestress a bridge in a longitudinal direction of the bridge.

The upper surface of the girder may protrude over the upper surface of the coping so that the girder functions as a deck bottom plate.

The girder may be assembled with the coping in such a way that the upper surface of the girder is level with the upper surface of the coping, thereby allowing an additional bottom plate to be closely attached to the girder.

Advantageous Effects

As described above, the upper structure for a bridge according to the present disclosure is advantageous in that the girders can be installed continuously without using conventional bridge bearings, thereby reducing the construction cost, in that the coping and the girders behave in an integrated state, thereby realizing improved structural efficiency of the bridge upper structure, and in that grooves are formed in the coping and the girders are held by being fitted into the respective grooves, so that the upper portion of the coping is not excessively exposed to the outside, thereby realizing a good appearance of the bridge.

Another advantage of the upper structure for a bridge according to the present disclosure resides in that the girders and the coping are thy-joined together in a prestressed state using prestressed steel strands that extend in the width directions of the bridge (longitudinal directions of the coping), so that the strength of the cross-section of a coping contact part of each of the girders can be increased and the resistance to a negative bending moment can be increased, and the girders and the coping can be integrated with each other without being processed by site work, thereby realizing improved structural efficiency of the bridge upper structure and reducing the construction period.

DESCRIPTION OF REFERENCE CHARACTERS OF IMPORTANT PARTS

Figure 1:
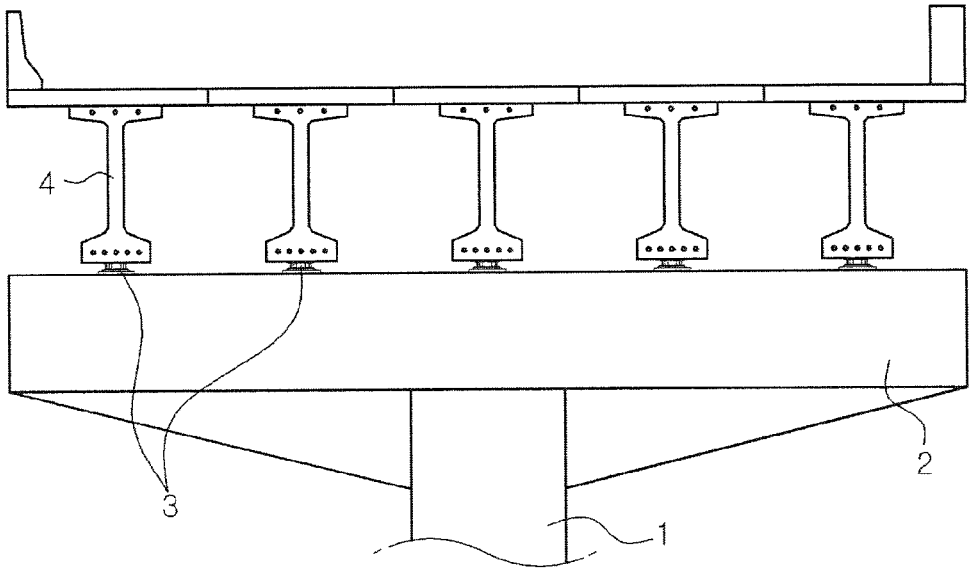
(PRIOR ART) FIG. 1
FIG. 1 is a sectional view illustrating a conventional upper structure for bridges.
Figure 2:
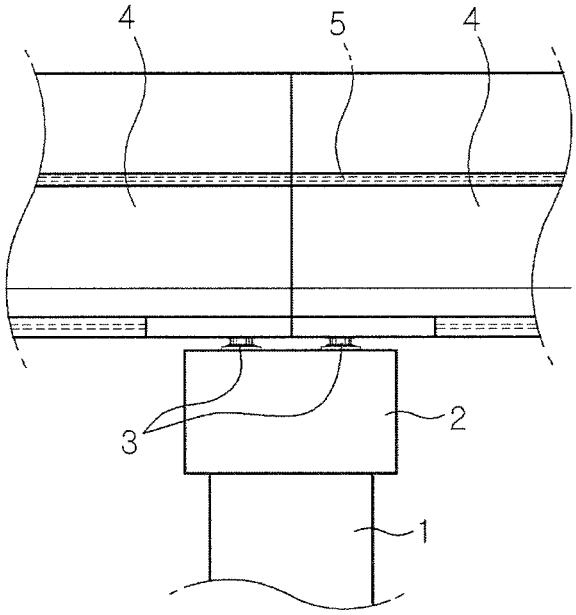
(PRIOR ART) FIG. 2
FIG. 2 is a side view of FIG. 1.

| | | | |
|---|---|---|---|
| 110: | pier | 120: | coping |
| 121: | horizontal part | 122: | vertical part |
| 122a: | grooves | 130: | girder |
| 131: | web | 132: | upper flange |
| 133: | lower flange | 141: | first prestressed member |

BEST MODE

Reference should now be made to the drawings, in which the same reference numerals are used throughout the different drawings to designate the same or similar components.

Hereinbelow, embodiments of the present disclosure will be described in detail with reference to the accompanying drawings.

Figure 3:
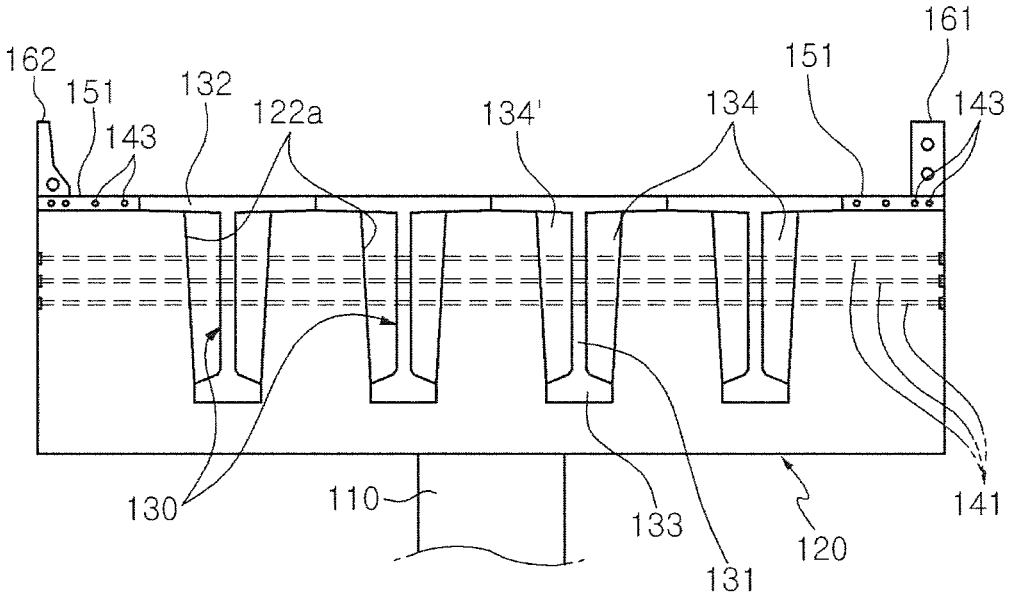
FIG. 3 is a sectional view illustrating an upper structure for a bridge according to an embodiment of the present disclosure.
Figure 4:
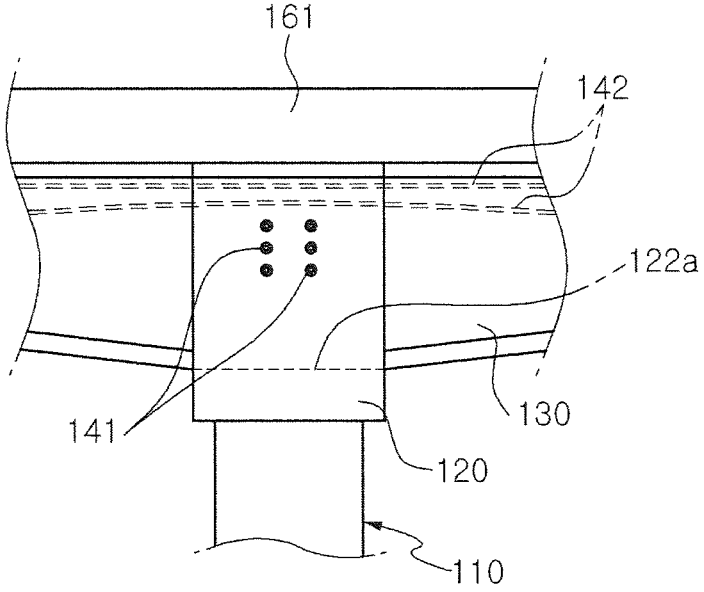
FIG. 4 is a side view of FIG. 3.

FIG. 3 is a sectional view illustrating an upper structure for a bridge according to an embodiment of the present disclosure, and FIG. 4 is a side view of FIG. 3. As shown in the drawings, a coping 120 is placed on the top end of a pier 110, and a plurality of girders 130 are held by the upper portion of the coping 120 in such a way that the girders 130 are perpendicular to the longitudinal direction of the coping and are spaced apart from each other at regular intervals. Here, the girders 130 are continuously connected to each other along a longitudinal direction of a bridge and form a continuous Rahmen bridge (see FIG. 6).

The coping 120 is a concrete structure that has a square cross-sectioned long shape extending along a width of the bridge.

In the coping 120, a plurality of grooves 122*a* are formed along a longitudinal direction of the coping 120 such that the grooves are spaced apart from each other at regular intervals, and so the plurality of girders 130 can be arranged by being fitted into the grooves 122*a*.

Here, to allow the girders 130 to be easily inserted into the grooves 122*a*, each of the grooves 122*a* has a reversed trapezoidal shape in which the upper end is wider than the lower end. However, it should be understood that the grooves 122*a* may be configured to have various shapes, such as a square shape, without being limited to the above-mentioned reversed trapezoidal shape. The upper ends of the grooves 122*a* are open.

Figure 5:
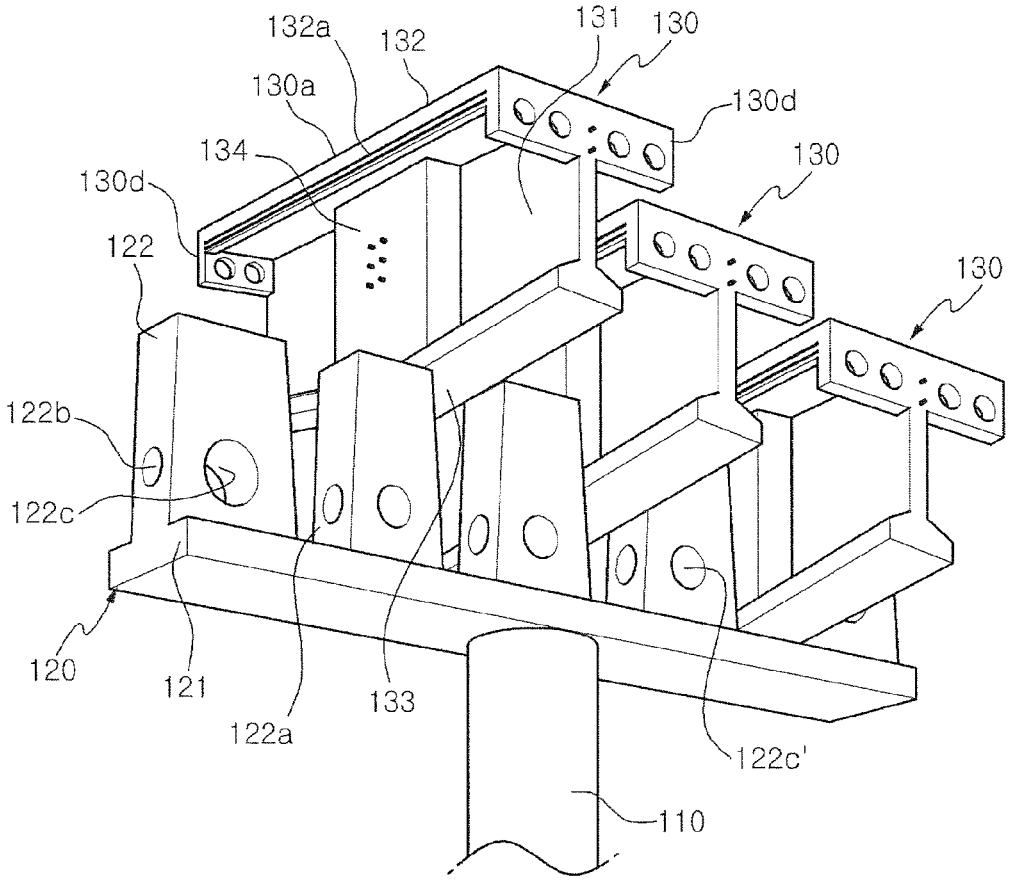
FIG. 5 is a perspective view illustrating a state in which girders of the upper structure for a bridge according to an embodiment of the present disclosure are being assembled.
Figure 6:
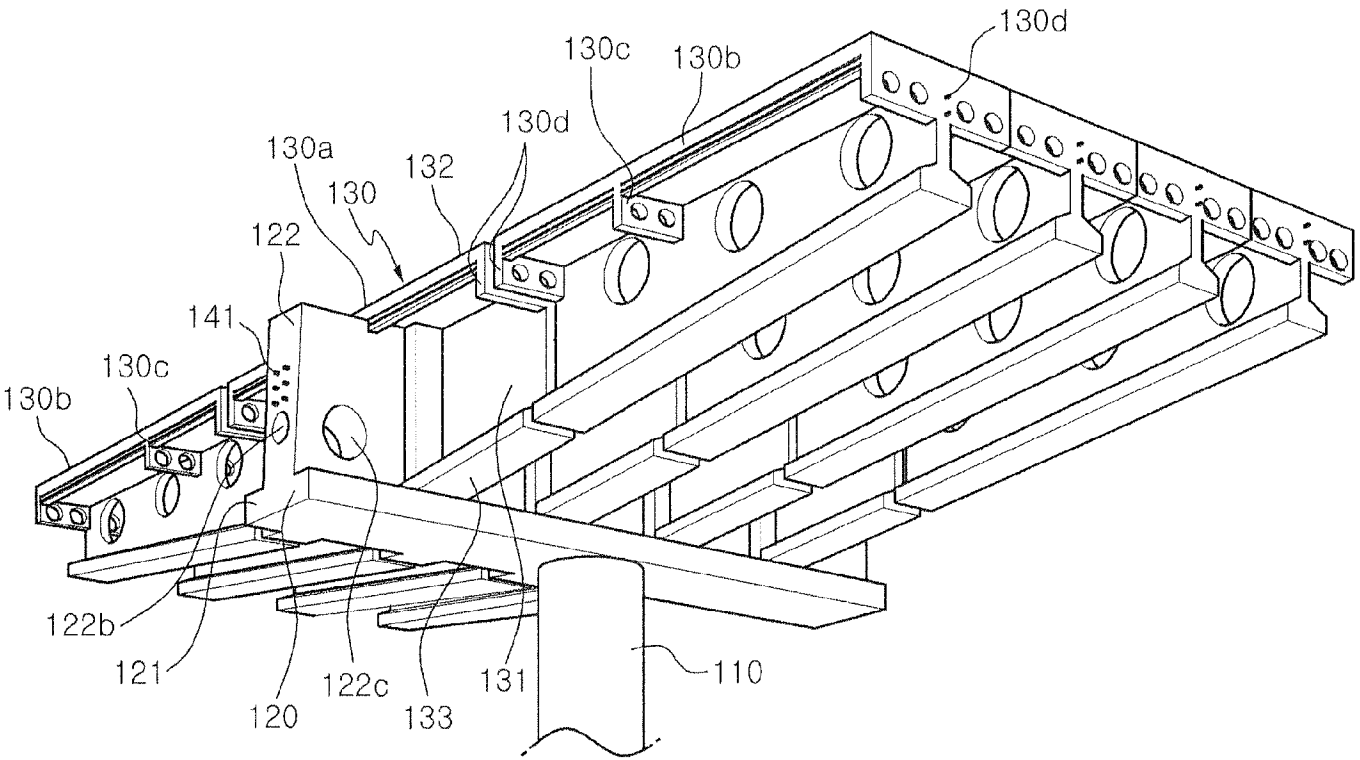
FIG. 6 is a perspective view illustrating a state in which the girders of the upper structure for a bridge according to the embodiment of the present disclosure are being assembled continuously.

Further, in an effort to reduce the weight of the coping 120, a plurality of hollow openings 122*b*, 122*c* and 122*c*' may be formed in the coping 120 along the longitudinal and width directions of the coping 120 (see FIGS. 5 and 6).

To prestress the bridge in a width direction, a plurality of first prestressed members (prestressed steel strands) 141 are installed in the coping 120 along the longitudinal direction of the coping 120 (here, the first prestressed members are installed after the installation of the girders is finished). The coping 120 and the girders 130 are joined together in a prestressed state by the plurality of first prestressed members 141. Here, opposite ends of each of the first prestressed members 141 are fixed to outside end surfaces of opposite vertical parts 122 of the coping 120 using respective fixtures.

In this embodiment of the present disclosure, unlike a wet-joining method of a comparative embodiment which will be described later herein, the girders 130 and the coping 120 are dry-joined together in a prestressed state using prestressed steel strands that extend in the width direction of the bridge (longitudinal direction of the coping), the strength of the cross-section of a coping contact part of each of the girders 130 can be increased by reinforcing parts 134 and 134' that will be described later herein, so that the resistance to a negative bending moment can be increased, and the girders and the coping can be integrated with each other without being processed by site work, thereby realizing improved structural efficiency of the upper structure of the bridge and reducing the construction period.

In the present disclosure, the coping 120 may be formed by connecting divided coping parts to each other at joints into a single coping.

Figures 7A, 7B, 7C:
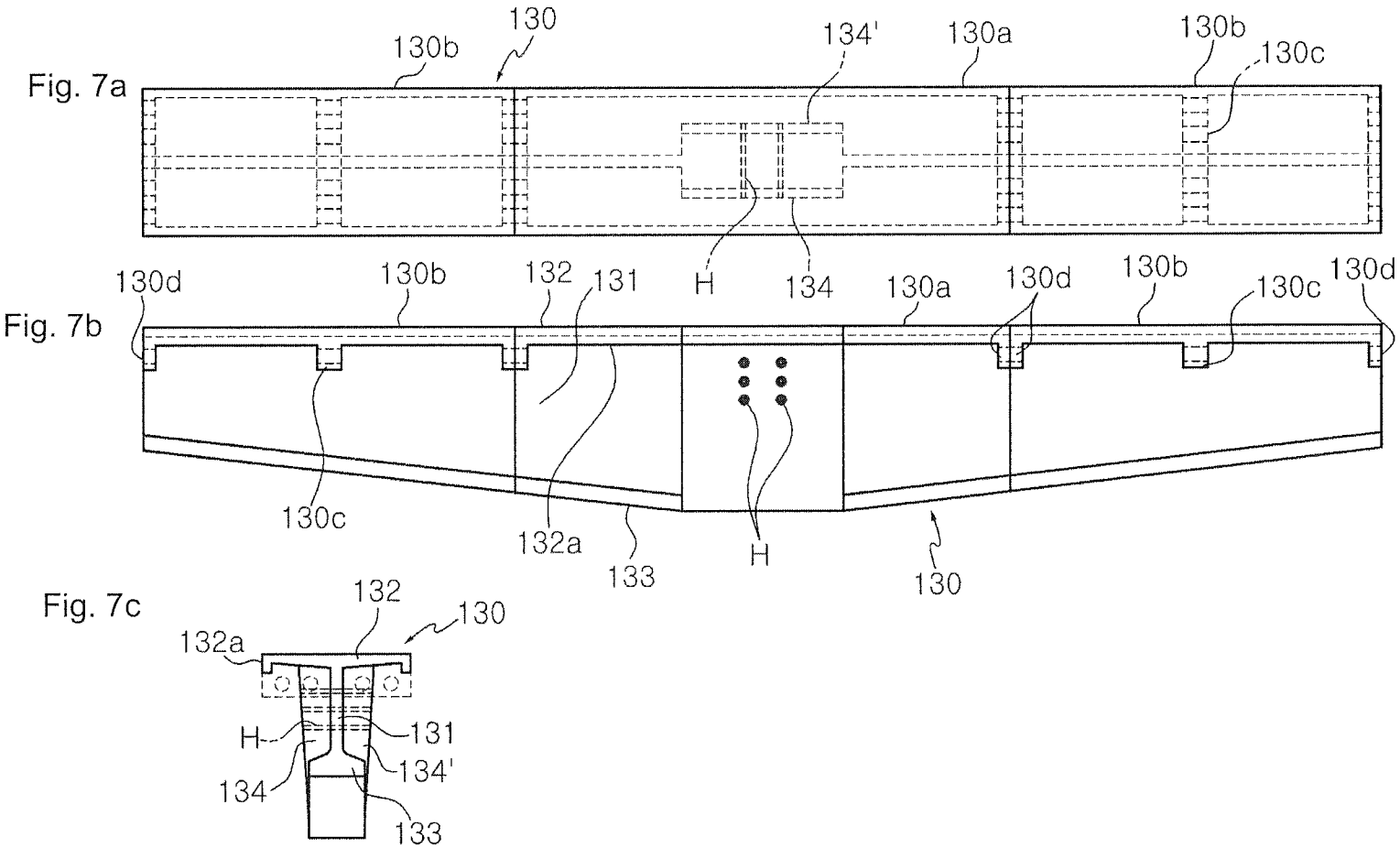
FIGS. 7(*a*), 7(*b*) and 7(*c*) are a plan view, an elevation view and a side view of the girder (bottom plate-integrated type of girder) of FIG. 6.

As shown in FIG. 6 and FIGS. 7(*a*), 7(*b*) and 7(*c*), the girders 130 are concrete structures which are laid on the coping 120 in such a way that they are arranged along the longitudinal direction of the bridge. Here, the girders 130 are perpendicularly placed on the coping 120 along the width direction of the bridge. In this embodiment of the present disclosure, each of the girders 130 comprises a central girder member 130*a* and two end girder members 130*b* that are mounted to opposite ends of the central girder member 130*a*. In the present invention, each of the girders 130 may be formed as a single member.

When describing the construction of the central girder member 130*a* as an example, each of the girders 130 has a modified I-beam structure, in which the reinforcing parts 134 and 134' are provided on opposite sides of a web 131 at locations between upper and lower flanges 132 and 133 of the center girder member 130*a* such that the reinforcing parts 134 and 134' come into close contact with opposed inner surfaces of an associated groove 122*a*. Here, the opposite outer surfaces of the reinforcing parts 134 and 134', at which the reinforcing parts 134 and 134' come into close contact with the opposed inclined inner surfaces of the groove 122*a* (trapezoidal groove), are inclined. Further, a sub-flange part 132*a* is formed along the lower surface of each side edge of the upper flange 132 by protruding from the lower surface downward.

Meanwhile, each of the end girder members 130*b* is provided with opposite lateral reinforcing beams 130*c* at a central portion thereof, and shear keys (not shown) are provided in joints 130*d* at which the central girder member 130*a* is joined to the opposite end girder members 130*b*.

Since the grooves 122*a* and the reinforcing parts 134 and 134' are configured to have reversed trapezoidal shapes in which the upper ends are wider than the lower ends, the present disclosure is advantageous in that it is easy to insert the girders 130 into the grooves 122*a* and the resistance to a negative bending moment can be increased.

Here, the height of the opposite ends of each of the girders 130 is equal to a girder height of the bridge, and the central part of the girder 130, at which the girder 130 is integrated with the coping 120, has an increased height in an effort to increase the resistance to a negative bending moment. Further, strand insert holes H are formed through each of the reinforcing parts 134 and 134' so that prestressed steel strands can be inserted into the holes H and the girders 130 can be integrated with the coping 120 into a single body by the steel strands.

Each of the girders 130 of this embodiment (FIGS. 3 to 7) has a bottom plate-integrated structure, in which the girder 130 is integrated with a deck bottom plate that functions to support a deck placed on the girders.

The lower flange 133 of each girder 130 comes into close contact with the bottom surface of the groove 122*a*, while the upper flange 132 of each girder 130 comes into close contact with the upper flanges 132 of neighboring girders 130 that are perpendicularly arranged along the width direction of the bridge so that the upper flanges 132 of the girders 130 function as a deck bottom plate of the bridge. Further, additional deck bottom plates 151 are installed on opposite ends of the upper surface of the coping 120 in such a way that the deck bottom plates 151 come into close contact with the respective upper flanges 132 of the girders 130 that are placed on opposite sides of the bridge in a width direction. The additional deck bottom plates 151 may be configured as a girder-integrated structure, in which the deck bottom plates 151 are integrated with the upper flanges 132 of the girders 130 that are placed on opposite sides of the bridge in a width direction.

When the girders 130 are assembled with the coping 120, the upper flanges 132 are laid on the coping 120 in such a way that the upper flanges 132 come into close contact with the upper surface the coping 120. On opposite ends of the upper flange 132 in the longitudinal direction, the joints 130*d* (see FIGS. 5 and 6) are formed so as to be connected to a neighboring central girder member 130*a* (see FIGS. 6 and 7) or to neighboring end girder members 130*b* (see FIGS. 6 and 7).

Further, to prestress the bridge in the longitudinal direction, a plurality of second prestressed members 142 (prestressed steel strands) are installed in the web 131 of each of the girders 130 along the longitudinal direction of the girder 130. Here, the second prestressed members 142 may be installed in the upper and lower flanges 132 and 133 of the girder 130.

To further prestress the bridge in the longitudinal direction, a plurality of third prestressed members 143 (prestressed steel strands) are installed in each of the additional deck bottom plates 151 along the longitudinal direction of the bridge. However, the deck bottom plates 151 may be constructed without having the prestressed members.

Protective walls 161 and 162 are installed on the upper surface of the deck bottom plate 151. Here, the protective walls 161 and 162 may be integrated with the deck bottom plate 151 or with the girders 130 into a single structure.

To reduce the weight of the girders 130 and 130', it is preferred to form a plurality of hollow openings in the web of each of the girders.

As shown in FIGS. 5 and 6, the coping 120 comprises a horizontal part 121 that is connected to the pier 110, and a vertical part 122 into which the girders 130 are inserted so as to be assembled with the coping 120. Here, the coping 120 illustrated in the drawings has a reversed T-shaped cross-section, as an example.

As shown in FIGS. 3 and 4, the coping 120 may be configured as a square cross-sectional coping comprising only the vertical part without having the horizontal part.

When constructing the above-mentioned upper structure for a bridge according to an embodiment of the present disclosure, the reinforcing parts 134 and 134' of the central girder members 130*a* of the girders 130 are inserted into the respective grooves 122*a* of the coping 120 such that the lower flanges 133 come into close contact with the bottom surfaces of the respective grooves 122*a*, thereby assembling the central girder members 130*a* with the coping 120, as shown in FIG. 5. In the above state, the upper surfaces of the upper flanges 132 of the central girder members 130*a* protrude over the upper surface of the coping 120, thereby functioning as a deck bottom plate.

Then, the first prestressed members 141 are inserted into the coping 120 along the longitudinal direction of the coping 120 such that the first prestressed members 141 pass through the central girder members 130*a* of the girders 130. Thereafter, as shown in FIG. 6, opposite end girder members 130*b* are mounted to the opposite ends of each of the central girder members 130*a* (this mounting can be accomplished using connection members (not shown) at the joints 130*d*). Further, the additional deck bottom plates 151 and the protective walls 161 and 162 are installed on the upper surfaces of the girders 130 and on the upper surface of the coping 120, thereby forming an upper structure for a bridge. Thereafter, the assembled upper structure is paved with cement or asphalt, thereby finishing the construction of a bridge. In the above-mentioned procedure, the second and third prestressed members are previously installed in the girders 130 and in the deck bottom plate 151.

Figures 8A, 8B, 8C:
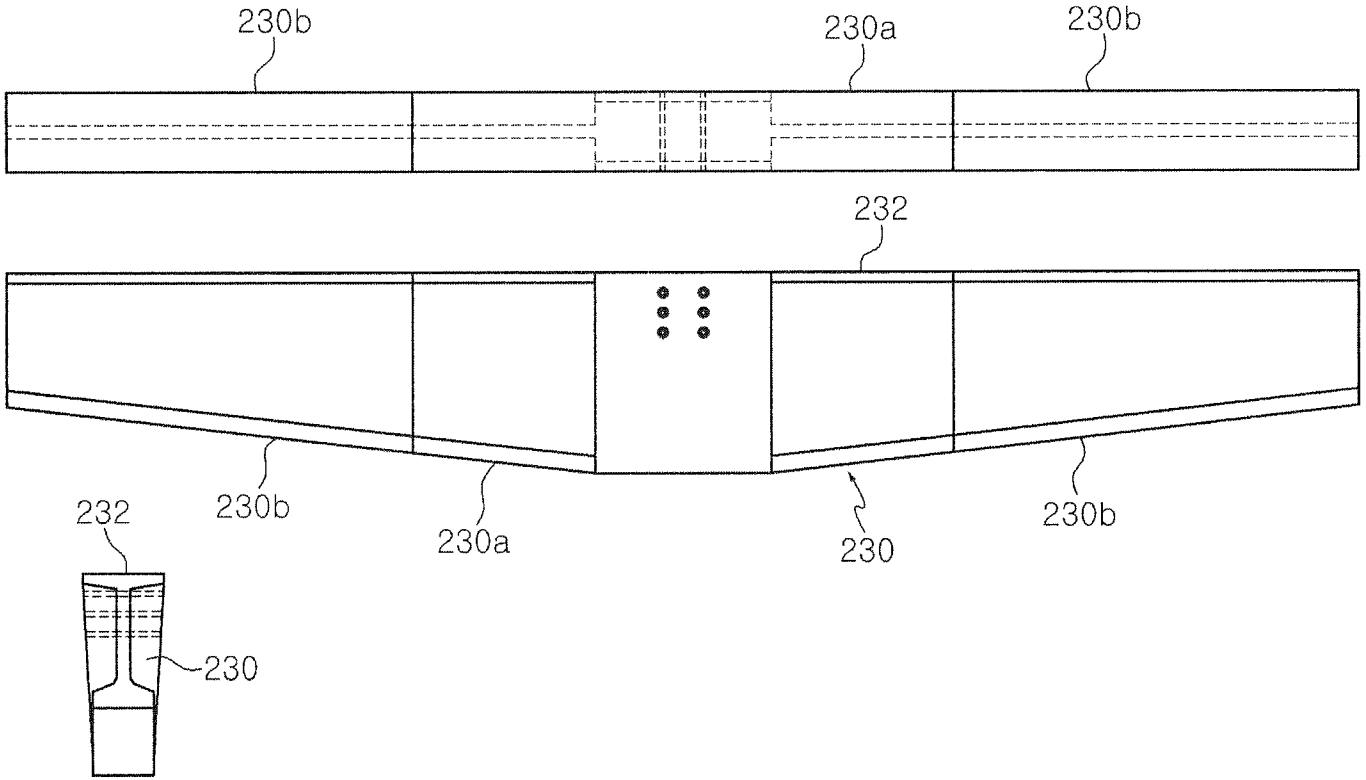
FIGS. 8(*a*), 8(*b*) and 8(*c*) are a plan view, an elevation view and a side view illustrating another embodiment (bottom plate-separated type of girder) of the girder of the upper structure for a bridge according to the present disclosure.

Meanwhile, FIGS. 8(*a*), 8(*b*) and 8(*c*) illustrate a girder 230 according to another embodiment of the present disclosure, in which the girder 230 is separated from a deck bottom plate placed on the girders. The girders 230 (bottom plate-separated type of girder) of this embodiment are assembled with a coping in such a way that the upper surfaces of upper flanges 232 of the girders 230 are level with the upper surface of the coping. Thereafter, an additional bottom plate is closely attached to the upper surfaces of the girders 230.

Each of the girders 230 according to this embodiment is a jointed type of girder, in which end girder members 230*b* are mounted to opposite ends of a central girder member 230*a* as described above. However, the girder 230 (bottom plate-separated type of girder) according to the embodiment shown in FIGS. 8(*a*), 8(*b*) and 8(*c*) has neither the sub-flange parts nor the lateral reinforcing beams, unlike the girder 130 according to the embodiment shown in FIGS. 7(*a*), 7(*b*) and 7(*c*), and the width of the upper flange 232 is shorter than that of the bottom plate-integrated type of girder.

In this embodiment (bottom plate-separated type of girder), the other shape of the girder remains the same as in the embodiment (bottom plate-integrated type of girder) shown in FIGS. 3 to 7(*c*), and further explanation is thus not deemed necessary.

Figure 9A:
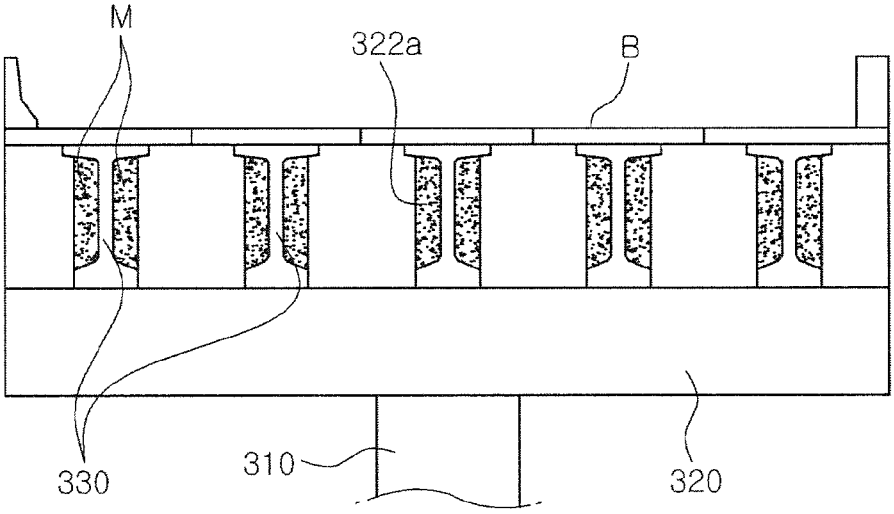
FIGS. 9(*a*) and 9(*b*) are a sectional view and a side view illustrating a comparative embodiment of the upper structure for a bridge according to the present disclosure.
Figure 9B:
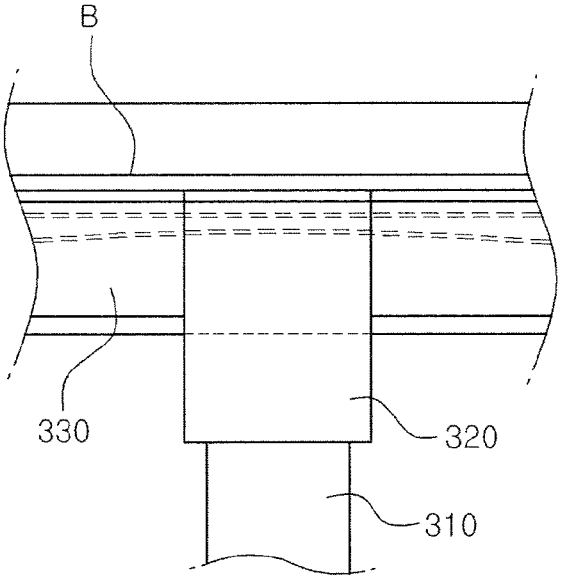

FIGS. 9(*a*) and 9(*b*) are a cross-sectional view and a side view illustrating an embodiment of the upper structure for bridge according to the present invention.

As shown in the drawings, this embodiment of the present disclosure is configured such that the upper structure for a bridge has a divided type of bottom plate B. The upper structure for a bridge according to this embodiment includes a coping 320 that is placed on the top end of a pier 310, and girders 330 having an I-shaped cross-section which are held by the coping 320, wherein the coping 320 is provided with rectangular grooves 322*a* for receiving the respective girders 330 therein so that the girders 330 can be installed in the coping 320 by being inserted into the grooves 322*a*. However, unlike the above-mentioned embodiments, this embodiment provides a wet-joining method, in which concrete or mortar M fills the spaces between the girders 330 and the grooves 322*a* after the girders 330 are inserted into the respective grooves 322*a* .

This wet-joining method is problematic in that it makes the construction work difficult, and the girders and the coping cannot behave in an integrated state due to structural limits thereof, thereby deteriorating the strength of the bridge upper structure and reducing the resistance to a negative bending moment, and failing to realize improved structural efficiency of the bridge upper structure. Accordingly, the bridge upper structure according to the first embodiment of the present disclosure (structure of FIGS. 3 and 4) is much better.

Although the preferred embodiments of the present disclosure have been disclosed for illustrative purposes, those skilled in the art will appreciate that various modifications, additions and substitutions are possible, without departing from the scope and spirit of the invention as disclosed in the accompanying claims.

What is claimed is:

1. An upper structure for a bridge, comprising a coping placed on a top end of a pier, and a girder held by the coping, wherein a groove is formed in the coping so as to receive the girder therein, so that the girder is held by the coping by being inserted into the groove;

wherein the groove has a reversed trapezoidal shape in which an upper end of the groove is wider than a lower end of the groove;

wherein the girder is provided with a reinforcing part such that the reinforcing part comes into close contact with an inner surface of the groove; and wherein the coping and the girder are connected to each other by a dry-joining method using a plurality of prestressed members passed through the girder and the coping.

2. The upper structure for a bridge as set forth in claim 1, wherein the coping comprises a plurality of grooves formed in a longitudinal direction of the coping such that a plurality of girders is arranged by being inserted into the grooves.

3. The upper structure for a bridge as set forth in claim 1, wherein the coping and/or the girder is provided with a plurality of hollow openings so as to reduce a weight thereof.

4. The upper structure for a bridge as set forth in claim 1, wherein the plurality of prestressed members are installed in a longitudinal direction of the coping so as to prestress the bridge in a width direction of the bridge.

5. The upper structure for a bridge as set forth in claim 1, wherein the girder is provided with a plurality of prestressed members that are installed in a longitudinal direction of the girder so as to prestress the bridge in a longitudinal direction of the bridge.

6. The upper structure for a bridge as set forth in claim 1, wherein an upper surface of the girder protrudes over an upper surface of the coping such that the girder functions as a deck bottom plate.

7. The upper structure for a bridge as set forth in claim 1, wherein the girder is assembled with the coping in such a way that an upper surface of the girder is level with an upper surface of the coping, thereby allowing an additional bottom plate to be closely attached to the girder.

* * * * *